US011530525B2

(12) United States Patent
Gratton et al.

(10) Patent No.: US 11,530,525 B2
(45) Date of Patent: Dec. 20, 2022

(54) LOAD-BASED ADJUSTMENT SYSTEM OF IMPLEMENT CONTROL PARAMETERS AND METHOD OF USE

(71) Applicant: DEERE & COMPANY, Moline, IL (US)

(72) Inventors: Michael R. Gratton, Asbury, IA (US); David Myers, Cedar Falls, IA (US); Aaron R. Kenkel, East Dubuque, IL (US); Michael G. Kean, Maquoketa, IL (US); Mary B. Wigginton, Dubuque, IA (US); Grant R. Henn, Dubuque, IA (US); Todd F. Velde, Dubuque, IA (US); Joseph R. Keene, Asbury, IA (US); Dustin T. Staade, Dubuque, IA (US); Kevin Campbell, Dubuque, IA (US); Thomas L. Kennedy, Dubuque, IA (US); Ryan Detweiler, Peosta, IA (US); Matthew Sbai, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 590 days.

(21) Appl. No.: 16/670,115

(22) Filed: Oct. 31, 2019

(65) Prior Publication Data

US 2021/0131071 A1 May 6, 2021

(51) Int. Cl.
*E02F 3/30* (2006.01)
*E02F 9/22* (2006.01)
(Continued)

(52) U.S. Cl.
CPC ..... *E02F 9/2246* (2013.01); *E02F 3/30* (2013.01); *E02F 3/401* (2013.01); *E02F 3/434* (2013.01)

(58) Field of Classification Search
CPC ..... E02F 9/2267; E02F 9/2246; E02F 9/2264; E02F 9/22; E02F 3/43; E02F 3/40;
(Continued)

(56) References Cited

U.S. PATENT DOCUMENTS 5,537,818 A 7/1996 Hosseini et al.
5,784,945 A * 7/1998 Krone ..... F15B 19/00 91/361
(Continued)

FOREIGN PATENT DOCUMENTS

DE 10393484 B4 * 4/2008 ..... E02F 9/2232
DE 10393484 B4 4/2008
DE 112006002748 T5 9/2008

OTHER PUBLICATIONS

F. Wang, Q. Wen, X. Xu, B. Xu and Z. Sun, "Site Operation Strategy for Wheel Loader/Truck Loading and Transportation Cycle," in IEEE Transactions on Vehicular Technology, vol. 70, No. 5, pp. 4129-4138, May 2021, doi: 10.1109/TVT.2021.3070394. (Year: 2021).*
(Continued)

*Primary Examiner* — Cuong H Nguyen
(74) *Attorney, Agent, or Firm* — Taft Stettinius & Hollister LLP; Stephen F. Rost

(57) ABSTRACT

A work machine includes a chassis, a boom coupled to the chassis, and a work implement coupled to the boom and movable relative to the chassis. In system may further include dynamic payload weighing system configured to measure the payload weight on the work implement. The system may also include an electrohydraulic system controller in communication with the dynamic payload weighing system and an electrohydraulic control valve electrically coupled to the electrohydraulic system controller and move-
(Continued)

able to a plurality of weight-specific valve positions based on the measured payload weight on the implement.

20 Claims, 2 Drawing Sheets

(51) Int. Cl.
*E02F 3/40* (2006.01)
*E02F 3/43* (2006.01)

(58) Field of Classification Search
CPC ..... E02F 3/30; F15B 2211/25; F15B 2211/71; F15B 2211/329
USPC ..... 701/50, 48; 37/446
See application file for complete search history.

(56) References Cited

U.S. PATENT DOCUMENTS 6,820,355 B2 * 11/2004 Yoshino ..... E02F 9/2282 91/392
8,818,699 B2 8/2014 Nichols et al.
9,725,882 B2 * 8/2017 Lee ..... F15B 11/161
2012/0205169 A1 8/2012 Montocchio et al.
2015/0225927 A1 * 8/2015 Hoshino ..... F02D 29/04 701/50
2015/0247513 A1 * 9/2015 Morris ..... E02F 9/2292 701/50
2015/0275469 A1 * 10/2015 Fredrickson ..... E02F 9/265 701/50
2015/0322649 A1 * 11/2015 Fleischmann ..... E02F 9/166 701/50
2016/0138240 A1 * 5/2016 Ikegami ..... E02F 9/26 60/420
2017/0107700 A1 4/2017 Faivre et al.
2017/0254049 A1 9/2017 Kean et al.

OTHER PUBLICATIONS

D. Jud, G. Hottiger, P. Leemann and M. Hutter, "Planning and Control for Autonomous Excavation," in IEEE Robotics and Automation Letters, vol. 2, No. 4, pp. 2151-2158, Oct. 2017, doi: 10.1109/LRA.2017.2721551. (Year: 2017).*

F. Wang, Z. Lin, B. Xu and W. Fiebig, "An Electric-Hydrostatic Energy Storage System for Hydraulic Hybrid Wheel Loader," in IEEE Transactions on Vehicular Technology, doi: 10.1109/TVT.2022.3167519. (Year: 2022).*

J. T. Jose, J. Das and S. K. Mishra, "Dynamic Improvement of Hydraulic Excavator Using Pressure Feedback and Gain Scheduled Model Predictive Control," in IEEE Sensors Journal, vol. 21, No. 17, pp. 18526-18534, Sep. 1, 2021, doi: 10.1109/JSEN.2021.3083677. (Year: 2021).*

German Search Report issued in application No. DE102020211681.4 dated Jun. 22, 2021 (10 pages).

* cited by examiner

LOAD-BASED ADJUSTMENT SYSTEM OF IMPLEMENT CONTROL PARAMETERS AND METHOD OF USE

FIELD OF THE DISCLOSURE

The present disclosure relates to an electrohydraulic system for a vehicle, and more particularly to an electrohydraulic system for a vehicle with a work implement.

BACKGROUND OF THE DISCLOSURE

Various machines or vehicles, for example those equipped with a boom and work implement, may include a several systems in communication with one another. The systems may include, for example, electrohydraulic components, engine components, transmission components, or all of the above. In some situations these components may operate differently based on the weight of a payload in the work implement.

It would be desirable for the functions of these components to be optimized based on known parameters, such as, for example, a determined payload weight in the work implement. This may present challenges, especially when attempting to measure a dynamic, or constantly changing, payload weight.

SUMMARY

In an illustrative embodiment of the present disclosure a work machine includes: a chassis; a boom coupled to the chassis; a work implement coupled to the boom and movable relative to the chassis; a dynamic payload weighing system configured to measure a payload weight on the work implement; an electrohydraulic system controller in communication with the dynamic payload weighing system; and an electrohydraulic control valve movable in response to a signal from the electrohydraulic system controller to manipulate fluid flow through the valve. The electrohydraulic system controller is configured to move the electrohydraulic control valve through a range of valve positions based on the payload weight on the work implement. The range of valve positions includes a first valve position in which the electrohydraulic control valve facilitates fluid flow at a first flow rate and a second valve position in which the electrohydraulic control valve facilitates fluid flow fluid at a second flow rate that is less than the first flow rate.

In some embodiments, the work implement is movable through a range of implement positions bounded by a stop position of the work implement; the range of implement positions includes a weight-specific implement-position; the electrohydraulic system controller is configured to move the electrohydraulic control valve from the first valve position to the second valve position as the work implement moves between the weight-specific implement position and the stop position; and the weight-specific implement position is based on the payload weight on the work implement.

In some embodiments, the second valve position is a weight-specific valve position based on the payload weight on the work implement. In some embodiments, the stop position is a predefined position selectable by an operator of the machine. In some embodiments, the stop position is defined by a physical, absolute positional limitation the machine.

In some embodiments, the electrohydraulic system controller is configured to move the electrohydraulic control valve from the second valve-position to the first valve-position in a weight-specific amount of time; and the weight-specific amount of time is based on the payload weight on the work implement.

In some embodiments, the electrohydraulic system controller is configured to prevent the electrohydraulic control valve from moving beyond the second valve position toward the first valve position; and the second valve position is a weight-specific valve position based on the payload weight on the work implement.

In some embodiments, the work machine includes an operator-controlled device; the electrohydraulic system controller is configured to (i) receive an operator input command from the operator-controlled device and (ii) cause a movement of the work implement in response to the operator input command; the operator input command corresponds to a requested flow rate; and the movement of the work implement corresponds to an output flow rate lesser than the requested flow rate.

In some embodiments, the input flow rate relative to the output flow rate defines a metering ratio; and the electrohydraulic system controller is configured to adjust the metering ratio based on the payload weight on the work implement.

In some embodiments, the work machine includes a transmission, and a transmission controller in communication with the transmission and the electrohydraulic system controller; and the transmission controller is configured to shift between a forward gear and a reverse gear of the transmission at a gear-shift rate; and the gear-shift rate is based on the payload weight on the work implement.

In some embodiments, the dynamic payload weighing system includes: an implement position sensor, an inertial measurement unit, and a cylinder pressure measurement unit.

In another illustrative embodiment, a work machine includes: a chassis; a boom coupled to the chassis; a work implement coupled to the boom and movable relative to the chassis; a dynamic payload weighing system configured to measure the payload weight on the work implement; an electrohydraulic system controller in communication with the dynamic payload weighing system; and an electrohydraulic control valve electrically coupled to the electrohydraulic system controller and moveable to a plurality of weight-specific valve positions. The electrohydraulic control valve facilitates a different amount of fluid flow in each weight-specific valve position. Each weight-specific valve position is based on the payload weight on the work implement.

In some embodiments, the work machine includes an engine, and an engine controller in communication with the engine and the electrohydraulic system controller to communicate an amount of torque available from the engine to the electrohydraulic system controller; and the plurality of weight-specific valve positions to which to the electrohydraulic control valve is moveable is limited by the amount of torque available from the engine.

In some embodiments, the work machine includes a transmission, and a transmission controller in communication with the transmission and the electrohydraulic system controller; the transmission controller is configured to shift between forward and reverse gears of the transmission at a gear-shift rate; and the gear-shift rate is based on the payload weight on the work implement. The electrohydraulic system controller is configured to receive a signal from the transmission controller indicative of a maximum torque requestable by the electrohydraulic system controller from the engine.

In another illustrative embodiment, a method of operating a work machine includes: determining a payload weight on a work implement of the work machine using a dynamic payload weighing system; and adjusting an electrohydraulic control valve of the work implement based on the determined payload weight.

In some embodiments, adjusting an electrohydraulic control valve of the work implement based on the determined payload weight includes: determining a weight-specific implement position of the work implement based on the payload weight on the work implement; moving the work implement from the weight-specific implement position to a stop position beyond which the implement can move no further; and adjusting the electrohydraulic control valve as the work implement moves between the weight-specific implement position and the stop position.

In some embodiments, adjusting the electrohydraulic control valve as the work implement moves between the weight-specific implement position and the stop position includes: determining a weight-specific valve position of the electrohydraulic control valve based on the payload weight on the work implement; and adjusting the electrohydraulic control valve such that the electrohydraulic control valve is disposed in the weight-specific valve position when the work implement reaches the stop position.

In some embodiments, adjusting an electrohydraulic control valve of the work implement based on the determined payload weight includes: determining a weight-specific amount of adjustment time based on the payload weight on the work implement; and adjusting the electrohydraulic control valve between a first valve position and a second valve position over the weight-specific amount of adjustment time.

In some embodiments, the method includes determining an amount of torque available from an engine of the work machine; and adjusting the electrohydraulic control valve of the work implement based on the determined amount of torque available from an engine. In some embodiments, the method includes communicating the payload weight from the dynamic payload weighing system to an electrohydraulic system controller.

In some embodiments, the method includes receiving, with the electrohydraulic system controller, an operator input command from an operator-controlled device, wherein the operator input command corresponds to a requested flow rate of fluid through the electrohydraulic control valve, and calculating an output flow rate based on the requested flow rate, wherein the output flow rate is less than the requested flow rate. In some embodiments, adjusting an electrohydraulic control valve of the work implement based on the determined payload weight includes: determining an adjusted output flow rate based on the payload weight on the work implement, and adjusting the electrohydraulic control valve to facilitate fluid flow at the adjusted output flow rate.

In some embodiments, the method includes determining a maximum flow rate of fluid allowed to pass through the electrohydraulic control valve based on the payload weight on the work implement; receiving, with the electrohydraulic system controller, an operator input command from an operator-controlled device, wherein the operator input command corresponds to an requested flow rate of fluid that is greater than the determined maximum flow rate of fluid. Adjusting an electrohydraulic control valve of the work implement based on the determined payload weight includes: adjusting the electrohydraulic control valve, in response to the operator input command, to facilitate fluid flow at the maximum flow rate of fluid.

In some embodiments, adjusting an electrohydraulic control valve of the work implement based on the determined payload weight includes: determining a weight-specific gear-shift rate between forward and reverse gears of a transmission of the work machine based on the determined payload weight; and adjusting an electrohydraulic control valve based on the determining weight-specific gear-shift rate.

In some embodiments, determining a payload weight on a work implement of a work machine using a dynamic payload weighing system includes: detecting a position of the work implement, determining the inertia of the work implement, and determining the pressure in a cylinder of a boom coupled to the work implement.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

Figure 1:
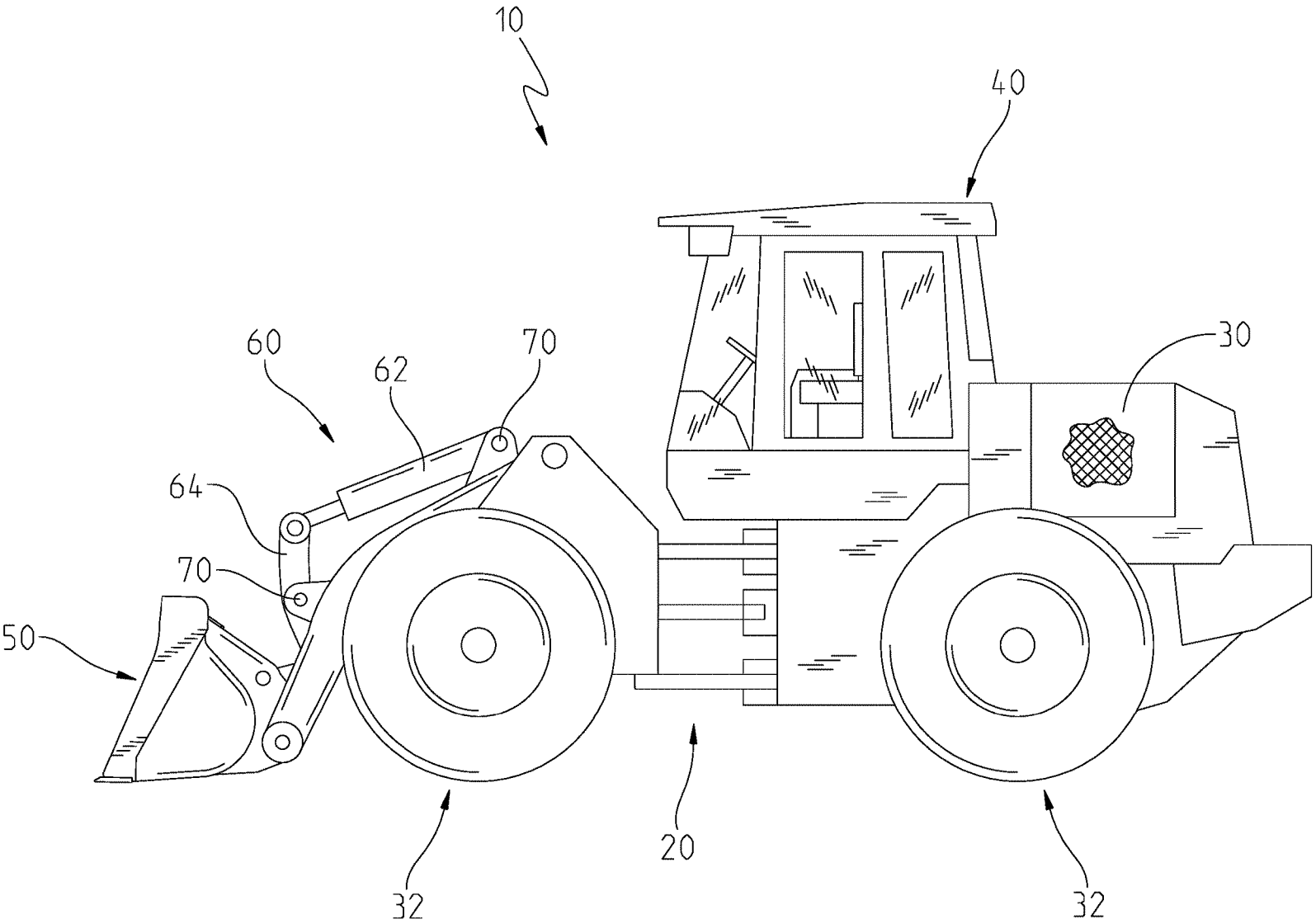
FIG. 1 is a side view of a work machine.

Referring to FIG. 1 of the present disclosure, an exemplary work machine 10 is shown The work machine 10 can be a mobile machine that performs operations associated with construction, agriculture, forestry, transportation, mining or other industry. The work machine 10 can include a chassis 20 that supports a power source 30, an operator cab 40, a work implement 50, and boom 60. The power source 30 may be an engine such as, for example, a diesel, gasoline, or other type of engine, that propels traction devices 32 for movement of the work machine 10. The work implement 50 can be movably attached to work machine 10 by the boom 60 which can include one or more boom cylinders 62, and a boom linkage 64. One or more boom linkage sensors 70 are coupled to the machine 10 to measure the position of the boom 60 and the work implement 50. In the illustrative embodiment, each boom linkage sensor 70 is be a rotational position sensor; however, it should be appreciated that each boom linkage sensor may be any position sensor sufficient to measure the position of the boom 60 or the work implement 50.

The boom cylinders 62 may be coupled to an accumulator, a hydraulic source, and a tank or fluid reservoir through a hydraulic circuit. Load sense lines can be used to monitor the status of various components of the hydraulic circuit.

Figure 2:
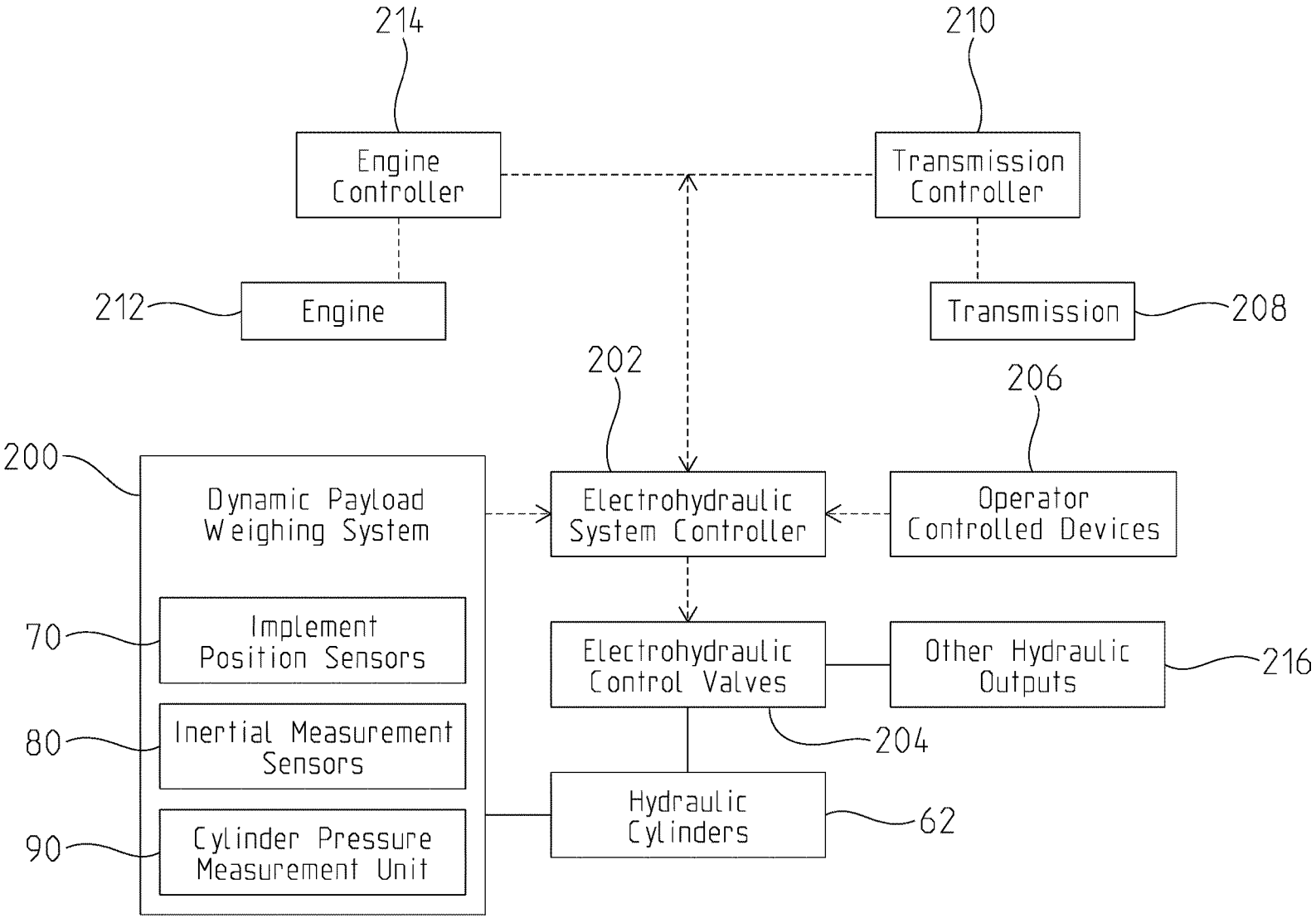
FIG. 2 is a schematic diagram of a control system for the work machine of FIG. 1.

As shown in FIG. 2, the work machine 10 includes a dynamic payload weighing system 200, configured to constantly measure the weight on the work implement 50. In addition to the boom linkage sensors 70 described above, the dynamic payload weighing system 200 also includes an inertial measurement unit 80, and a cylinder pressure measurement unit 90. Together the boom linkage sensors 70, the inertial measurement unit 80, and the cylinder pressure measurement unit 90 can constantly determine the weight on the work implement 50 during operation of the work machine 10. The dynamic payload weighing system 200 is electrically coupled to an electrohydraulic system controller 202 to communicate the dynamic payload weight to the system controller 202. The electrohydraulic system controller 202 is configured to control or adjust the flow rate through one or more electrohydraulic control valves 204 based on the payload weight on the implement 50.

In the illustrative embodiment, to achieve such control, the electrohydraulic system controller 202 may be electrically coupled to the one or more electrohydraulic control valves 204. The electrohydraulic control valves 204 are fluidly coupled to the hydraulic cylinders 62 and configured to adjust the flow rate of fluid to the hydraulic cylinders 62. In this configuration, the electrohydraulic system controller 202 is configured to move an electrohydraulic control valve 204 through a range of valve positions. In the illustrative embodiment, the range of valve positions includes at first valve position in which the electrohydraulic control valve 204 facilitates fluid flow at least a first flow rate and a second valve position in which the electrohydraulic control valve 204 facilitates fluid flow fluid at a second flow rate.

The work implement 50 is movable through ranges of positions or range of motion. For example, the implement 50 may curl and dump, as well as raise and lower. Each of these ranges of motion includes stop positions that define boundaries of the range of motion for the particular movement of the implement 50. Additionally, an operator or other user may set a predefined stop position beyond which the implement can advance no further in a particular movement. These stop positions can be pre-programmed into a memory of the machine 10 for any number of reasons including: identification of a desired height or dump-angle for a commonly repeated action of the implement, a height-limit or curl-limit associated with a known implement type, etc. In some applications, it may be desirable to automatically reduce the flow rate of fluid to the hydraulic cylinders 62 as the implement 50 approaches a stop position. Such an automatic reduction in flow rate may be referred to as "cushioning". The cushioning feature of the work machine 10 may improve ride comfort, safety, and operating efficiency of the machine 10.

As suggested by FIG. 2, the system controller 202 is electrically coupled to the implement position sensors 70 and configured to receive a signal indicative of the position of the work implement 50. As the work implement 50 approaches a stop position, the electrohydraulic system controller 202 reduces the fluid flow rate through the electrohydraulic control valves 204 based on the payload weight on the implement 50. Accordingly, if the dynamic payload weighing system 200 indicates a greater load on the implement 50, the electrohydraulic system controller 202 will request a greater reduction in flow as the implement approaches a stop position; comparatively, if the dynamic payload weighing system 200 indicates a lesser load on the implement 50, the electrohydraulic system controller 202 will request a lesser reduction in flow as the implement 50 approaches a stop position. Thus, this function allows for optimization of a stop-position-flow-rate value for the cushioning feature of the work machine 10 based on the payload weight on the implement 50.

As the implement 50 moves through its range of positions, the electrohydraulic system controller 202 is configured to adjust the fluid flow rate through the electrohydraulic control valves 204 at a predetermined position of the implement 50. In other words, as the implement 50 moves toward a stop position, the flow rate is reduced beginning when the implement 50 reaches the predetermined position. It should be appreciated that the predetermined position is based on the weight on the implement 50. The predetermined position may be referred to as a weight-specific position. When the implement 50 reaches the weight-specific position, the electrohydraulic system controller 202 is configured to move the electrohydraulic control valve 204 from a first valve position associated with a first flow rate to a second valve position associated with a second, lesser flow rate.

If the dynamic payload weighing system 200 indicates a greater load on the implement 50, the electrohydraulic system controller 202 will request a reduction in flow at a first position of the implement 50 relative to a stop position; comparatively, if the dynamic payload weighing system 200 indicates a lesser load on the implement 50, the electrohydraulic system controller 202 will request a reduction in flow beginning at a second position of the implement, where the second position of implement 50 is a greater distance away from the stop position than is the first position of the implement 50. This function allows for optimized initiation of the cushioning feature of the work machine 10 based on the payload weight on the implement 50.

It may be desirable to adjust fluid flow at greater or lesser adjustment rates based on the weight on the implement 50. For example, in some embodiments, an operator of the work machine may request a near-instantaneous increase or decrease in the fluid flow rate; however, the work machine 10 may automatically adjust the fluid flow rate over a longer period of time rather than nearly instantaneously. This delay in flow rate adjustment may be introduced to improve operator comfort, safety, or machine efficiency. The period of time over which the adjustment in flow rate occurs is based on the weight on the implement 50, and may be referred to as a weight-specific amount of time. For example, if the dynamic payload weighing system 200 indicates a greater load on the implement 50, the electrohydraulic system controller 202 will adjust the position of the valve 204 more slowly (i.e. the weight specific amount of time will be greater); comparatively, if the dynamic payload weighing system 200 indicates a lesser load on the implement 50, the electrohydraulic system controller 202 will adjust the position of the valve 204 more quickly (i.e. the weight specific amount of time will be lesser). This function allows for optimization of the flow rate adjustment time for the work machine 10 based on the payload weight on the implement 50.

In some embodiments, the electrohydraulic system controller 202 is capable of controlling the maximum flow rate for the implement 50. The maximum flow rate may be based on the weight on the implement 50. It should be appreciated that in each embodiment, various implements 50 may be used with the work machine 10, and each implement 50 may have a different weight. Thus, when the phrase "payload weight on the implement" or "weight on the implement" are used, the terms are used to describe the total weight on the implement 50 inclusive of the weight of the implement 50 itself.

In the illustrative embodiment, a maximum flow rate may be determined. The maximum flow rate may be associated with a weight-specific position of the electrohydraulic control valve 204. As such, the electrohydraulic system controller 202 is configured to prevent the electrohydraulic control valve 204 from moving beyond the weight-specific valve position. As described above, the weight-specific valve position is based on the payload weight on the implement 50. This function allows for optimization of the maximum flow rate-limit for the work machine 10 based on the payload weight on the implement 50.

It may be desirable to adjust the difference between an operator-requested (or input) flow rate versus an actual (or output) flow rate based on the weight on the implement 50. For example, in some embodiments, an operator of the work machine 10 may request a first fluid flow rate; however, the work machine 10 may automatically output a second, lesser fluid flow rate. This reduction in actual flow rate may be introduced to improve operator comfort, safety, or machine efficiency. The value of the difference between the input fluid flow rate and the output fluid flow rate may change with the magnitude of the fluid flow rate requested by the operator. This changing value of the difference describe above may be graphical represented and referred to as a metering curve. The metering curve may be adjusted based on the weight on the implement 50.

As shown in FIG. 2, the work machine 10 includes an operator-controlled device 206. The electrohydraulic system controller 202 is electrically to the coupled operator-controlled device 206 to receive operator inputs command from the operator-controlled device 206. The electrohydraulic system controller 202 is configured to cause a movement of the work implement 50 in response to the operator input command. While the operator input command corresponds to the operator-requested flow rate, the resulting movement of the work implement 50 corresponds to an output flow rate that is less than the operator-requested flow rate. The input (operator-requested) flow rate relative to the output (actual) flow rate defines a metering ratio, and the electrohydraulic system controller 202 is configured to adjust the metering ratio based on the payload weight on the work implement 50. This function allows for optimization of metering curves for the work machine 10 based on the payload weight on the implement 50.

As shown in FIG. 2, the work machine 10 includes a transmission 208 and a transmission controller 210 electrically coupled to the transmission 208. Further, the transmission controller 210 is electrically coupled to the electrohydraulic system controller 202 and thereby the dynamic payload weighing system 200. The transmission controller 210 is configured to shift gears of the transmission 208 between a forward gear and a reverse gear at a weight-specific gear-shift rate. The weight-specific gear-shift rate is based on the payload weight on the work implement 50. Accordingly, if the dynamic payload weighing system 200 indicates a greater load on the implement 50, the electrohydraulic system controller 202 will shift between forward and reverse gears of the transmission 208 more slowly; comparatively, if the dynamic payload weighing system 200 indicates a lesser load on the implement 50, the electrohydraulic system controller 202 will shift between forward and reverse gears of the transmission 208 more quickly. This function allows for optimization of gear-shift rates for the work machine 10 based on the payload weight on the implement 50.

As shown in FIG. 2, the electrohydraulic system controller 202 is coupled to the valves 204, which are in turn coupled to the hydraulic cylinder 62 for the implement 50 and to other hydraulic outputs 216. The work machine 10 further includes an engine 212 and an engine controller 214 electrically coupled to the engine 212. Additionally, the engine controller 214 is electrically coupled to the electrohydraulic system controller 202 and thereby the dynamic payload weighing system 200. The engine 212 is configured to produce an amount of torque for the work machine 10, some of which is used by the hydraulic cylinders 62 to support or move the implement 50. The amount of torque required from the engine 212, to support the implement 50 is dependent on the weight on the implement 50. Thus, the amount of excess torque available from the engine 214 is also dependent on the weight on the implement 50.

In some embodiments, a power management system may be included with or as a part of the electrohydraulic system controller 202. The power management system may be configured to determine an amount of torque required from the engine 212 to support various components of the electrohydraulic circuit. However, in some work machines, especially those without a dynamic payload weighing system 200, the weight on the implement is always assumed to be a maximum value for purposes of determining the amount of excess torque available from the engine. Thus, the power management system of such machines cannot determine the amount of torque required to support various components of the electrohydraulic circuit as accurately as may be desired.

In the embodiment described here, the actual weight on the implement is determined by the dynamic payload weighing system 200, and therefore, the amount of torque required by the implement 50 can be measured constantly and more accurately. In such an embodiment, if the dynamic payload weighing system 200 indicates a lesser load on the implement 50, the electrohydraulic system controller 202 can initiate greater flows rate in the electrohydraulic circuit than if the dynamic payload weighing system 200 were to indicate a greater load on the implement 50. In this configuration, the electrohydraulic system controller 202 is configured to adjust the electrohydraulic control valves 204 that are coupled to the other hydraulic outputs 216 based on the weight on the implement 50. This function allows for optimization of flow rates associated with the other hydraulic outputs 216 of the work machine 10 based on the payload weight on the implement 50.

While embodiments incorporating the principles of the present disclosure have been described hereinabove, the present disclosure is not limited to the described embodiments. Instead, this application is intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. A work machine comprising:

a chassis;

a boom coupled to the chassis;

a work implement coupled to the boom and movable relative to the chassis;

a dynamic payload weighing system configured to measure a payload weight on the work implement;

an electrohydraulic system controller in communication with the dynamic payload weighing system; and an electrohydraulic control valve movable in response to a signal from the electrohydraulic system controller to manipulate fluid flow through the valve;

wherein the electrohydraulic system controller is configured to move the electrohydraulic control valve through a range of valve positions based on the payload weight on the work implement; and wherein the range of valve positions includes a first valve position in which the electrohydraulic control valve facilitates fluid flow at a first flow rate and a second valve position in which the electrohydraulic control valve facilitates fluid flow fluid at a second flow rate that is less than the first flow rate.

2. The work machine of claim 1, wherein:

the work implement is movable through a range of implement positions bounded by a stop position of the work implement;

the range of implement positions includes a weight-specific implement-position;

the electrohydraulic system controller is configured to move the electrohydraulic control valve from the first valve position to the second valve position as the work implement moves between the weight-specific implement position and the stop position; and the weight-specific implement position is based on the payload weight on the work implement.

3. The work machine of claim 2, wherein the second valve position is a weight-specific valve position based on the payload weight on the work implement.

4. The work machine of claim 2, wherein the stop position is a predefined position selectable by an operator of the machine.

5. The work machine of claim 1, wherein:

the electrohydraulic system controller is configured to move the electrohydraulic control valve from the second valve-position to the first valve-position in a weight-specific amount of time; and the weight-specific amount of time is based on the payload weight on the work implement.

6. The work machine of claim 1, wherein:

the electrohydraulic system controller is configured to prevent the electrohydraulic control valve from moving beyond the second valve position toward the first valve position; and the second valve position is a weight-specific valve position based on the payload weight on the work implement.

7. The work machine of claim 1, wherein:

the work machine further comprises an operator-controlled device;

the electrohydraulic system controller is configured to (i) receive an operator input command from the operator-controlled device and (ii) cause a movement of the work implement in response to the operator input command;

the operator input command corresponds to a requested flow rate; and the movement of the work implement corresponds to an output flow rate lesser than the requested flow rate.

8. The work machine of claim 7, wherein:

the input flow rate relative to the output flow rate defines a metering ratio; and the electrohydraulic system controller is configured to adjust the metering ratio based on the payload weight on the work implement.

9. The work machine of claim 1, wherein:

the work machine further comprises a transmission, and a transmission controller in communication with the transmission and the electrohydraulic system controller;

the transmission controller is configured to shift between a forward gear and a reverse gear of the transmission at a gear-shift rate; and the gear-shift rate is based on the payload weight on the work implement.

10. A work machine comprising:

a chassis;

a boom coupled to the chassis;

a work implement coupled to the boom and movable relative to the chassis;

a dynamic payload weighing system configured to measure the payload weight on the work implement;

an electrohydraulic system controller in communication with the dynamic payload weighing system; and an electrohydraulic control valve electrically coupled to the electrohydraulic system controller and moveable to a plurality of weight-specific valve positions;

wherein:

the electrohydraulic control valve facilitates a different amount of fluid flow in each weight-specific valve position, and each weight-specific valve position is based on the payload weight on the work implement.

11. The work machine of claim 10, wherein:

the work machine further comprises:

an engine, and an engine controller in communication with the engine and the electrohydraulic system controller to communicate an amount of torque available from the engine to the electrohydraulic system controller; and the plurality of weight-specific valve positions to which to the electrohydraulic control valve is moveable is limited by the amount of torque available from the engine.

12. The work machine of claim 10, wherein:

the work machine further comprises a transmission, and a transmission controller in communication with the transmission and the electrohydraulic system controller;

the transmission controller is configured to shift between forward and reverse gears of the transmission at a gear-shift rate; and the gear-shift rate is based on the payload weight on the work implement.

13. A method of operating a work machine comprising:

measuring, with a dynamic payload weighing system, a payload weight on a work implement of the work machine; and adjusting, with an electrohydraulic system controller, an electrohydraulic control valve of the work implement based on the determined payload weight, which includes:

determining a weight-specific implement position of the work implement based on the payload weight on the work implement;

moving the work implement from the weight-specific implement position to a stop position beyond which the implement can move no further; and adjusting an electrohydraulic control valve of the work implement as the work implement moves between the weight-specific implement position and the stop position.

14. A method of operating a work machine comprising:

determining, with a dynamic payload weighing system, a payload weight on a work implement of the work machine; and adjusting, with an electrohydraulic system controller, an electrohydraulic control valve of the work implement based on the determined payload weight, which includes:

determining a weight-specific amount of adjustment time based on the payload weight on the work implement; and adjusting the electrohydraulic control valve between a first valve position and a second valve position over the weight-specific amount of adjustment time.

15. The method of claim 13, wherein adjusting the electrohydraulic control valve as the work implement moves between the weight-specific implement position and the stop position includes:

determining a weight-specific valve position of the electrohydraulic control valve based on the payload weight on the work implement; and adjusting the electrohydraulic control valve such that the electrohydraulic control valve is disposed in the weight-specific valve position when the work implement reaches the stop position.

16. The method of claim 13, further comprising:

determining a weight-specific amount of adjustment time based on the payload weight on the work implement; and adjusting the electrohydraulic control valve between a first valve position and a second valve position over the weight-specific amount of adjustment time.

17. The method of claim 13, further comprising:

determining an amount of torque available from an engine of the work machine; and adjusting the electrohydraulic control valve of the work implement based on the determined amount of torque available from an engine.

18. The method of claim 13, further comprising sending a signal indicative of the payload weight from the dynamic payload weighing system to an electrohydraulic system controller that is coupled to the dynamic payload weighing system.

19. The method of claim 18, further comprising:

receiving, with the electrohydraulic system controller, an operator input command from an operator-controlled device, wherein the operator input command corresponds to a requested flow rate of fluid through the electrohydraulic control valve, and calculating an output flow rate based on the requested flow rate, wherein the output flow rate is less than the requested flow rate, wherein adjusting an electrohydraulic control valve of the work implement based on the determined payload weight includes:

determining an adjusted output flow rate based on the payload weight on the work implement, and adjusting the electrohydraulic control valve to facilitate fluid flow at the adjusted output flow rate.

20. The method of claim 18, further comprising:

determining a maximum flow rate of fluid allowed to pass through the electrohydraulic control valve based on the payload weight on the work implement;

receiving, with the electrohydraulic system controller, an operator input command from an operator-controlled device, wherein the operator input command corresponds to an requested flow rate of fluid that is greater than the determined maximum flow rate of fluid;

wherein adjusting an electrohydraulic control valve of the work implement based on the determined payload weight includes:

adjusting the electrohydraulic control valve, in response to the operator input command, to facilitate fluid flow at the maximum flow rate of fluid.

* * * * *